US009617754B2

(12) United States Patent
Ramsauer

(10) Patent No.: US 9,617,754 B2
(45) **Date of Patent: *Apr. 11, 2017**

(54) CLIP FIXING ELEMENT FOR THE ASSEMBLY OF FIXTURE DEVICES SUCH AS LOCKS, HINGE PARTS AND HANDLES IN OPENINGS IN A THIN WALL

(76) Inventor: Dieter Ramsauer, Schwelm (DE)

( * ) Notice: Subject to any disclaimer, the term of this patent is extended or adjusted under 35 U.S.C. 154(b) by 1367 days.

This patent is subject to a terminal disclaimer.

(21) Appl. No.: 10/587,367

(22) PCT Filed: Jan. 26, 2005

(86) PCT No.: PCT/EP2005/000728

§ 371 (c)(1),
(2), (4) Date: Apr. 26, 2007

(87) PCT Pub. No.: WO2005/071192

PCT Pub. Date: Aug. 4, 2005

(65) Prior Publication Data

US 2007/0271735 A1 Nov. 29, 2007

(30) Foreign Application Priority Data

Jan. 26, 2004 (DE) ..... 20 2004 001 161 U
Feb. 27, 2004 (DE) ..... 20 2004 003 238 U

(51) Int. Cl.
*E05C 9/00* (2006.01)
*E05B 9/08* (2006.01)
*E05B 1/00* (2006.01)

(52) U.S. Cl.
CPC ..... *E05B 9/08* (2013.01); *E05B 1/0092* (2013.01); *Y10S 411/913* (2013.01);
(Continued)

(58) Field of Classification Search
CPC ..... E05B 63/0056; E05B 53/005; E05B 9/08; E05B 1/0092; E05C 19/028;
(Continued)

(56) References Cited

U.S. PATENT DOCUMENTS 1,399,159 A * 12/1921 Segal ..... 70/370
1,426,239 A * 8/1922 Witzberger ..... F16B 5/0642 248/27.3

(Continued)

FOREIGN PATENT DOCUMENTS

BE 883121 * 11/1980 ..... E05B 9/08
DE 342387 10/1921

(Continued)

*Primary Examiner* — Kristina Fulton
*Assistant Examiner* — Nathan Cumar
(74) *Attorney, Agent, or Firm* — Frommer Lawrence & Haug LLP

(57) ABSTRACT

The description relates to a snap fastening for mounting fittings such as socket wrench latches, swivel lever latches, hinge parts, handles, fixing brackets for door stops or flap supports in openings in a thin wall, comprising a head part which is to be arranged on one, outer side of the thin wall and which overlaps the outer rim of the opening, and a body part which proceeds from the head part and projects through the opening in the mounted position, and holding elements which project from the body part and are flexible in direction of its outer surface against spring force, the free end of these holding elements being provided with an inclined surface for supporting the body part without play on the rim or edge of the opening of the other, inner side of the thin wall, wherein the body part and holding element and the spring generating the spring force are separate parts.

19 Claims, 22 Drawing Sheets

(52) U.S. Cl.
CPC ..... *Y10T 16/5358* (2015.01); *Y10T 16/554* (2015.01); *Y10T 16/5543* (2015.01); *Y10T 16/95* (2015.01); *Y10T 70/7655* (2015.04)

(58) Field of Classification Search
CPC ..... Y10T 16/5358; Y10T 16/554; Y10T 16/5543; Y10T 16/95; Y10T 70/7655; Y10S 411/913
USPC ..... 292/32, 16, 8, 24, 28, 121, 95; 411/508, 411/913, 342; 16/382–383, 257–258, 16/271–272; 70/208, 370, 449
See application file for complete search history.

(56) References Cited

U.S. PATENT DOCUMENTS 3,583,736 A * 6/1971 Willimzik ..... 292/16
3,921,334 A * 11/1975 Black, Sr. ..... 49/56
4,687,236 A * 8/1987 Rasche ..... 292/16
4,882,919 A * 11/1989 Craig ..... 70/200
5,251,467 A * 10/1993 Anderson ..... 70/370
5,435,159 A * 7/1995 Ramsauer ..... E05B 9/084 70/370
5,704,661 A * 1/1998 Takimoto ..... 292/162
5,975,592 A * 11/1999 Lin ..... 292/37
6,115,239 A * 9/2000 Kim ..... 361/679.57
6,145,352 A * 11/2000 Vickers et al. ..... 70/208
6,508,092 B1 * 1/2003 Laabs ..... E05B 9/084 24/297
6,553,796 B2 * 4/2003 Finch ..... 70/208
7,322,127 B2 * 1/2008 Hwang ..... 34/603
7,410,194 B2 * 8/2008 Chen et al. ..... 292/37
7,690,083 B2 * 4/2010 Ramsauer ..... E05B 9/08 16/258
8,887,819 B2 * 11/2014 Lee ..... A62C 37/36 169/16
2007/0271735 A1 * 11/2007 Ramsauer ..... E05B 9/08 16/404
2011/0247837 A1 * 10/2011 Lee ..... A62C 35/58 169/37

FOREIGN PATENT DOCUMENTS

DE 39 04 535 8/1990
DE 9411368 U1 * 9/1994 ..... E05B 35/008
DE 9411368 10/1994
DE 9411368.8 10/1994
EP 0 258 491 3/1988
FR 670715 12/1929
FR 2 746 944 10/1997
FR 2 791 080 9/2000
FR 2791080 A1 * 9/2000 ..... E05B 9/082

* cited by examiner

Fig.2.
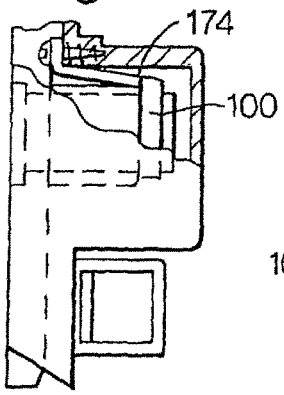
Fig.3.
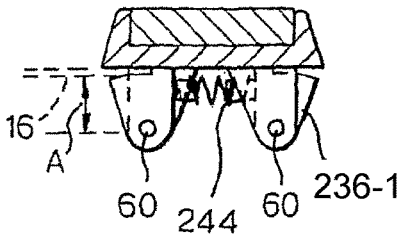
Fig.9B.
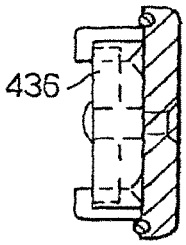
Fig.9 A.
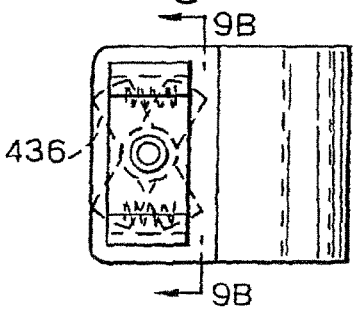
Fig.9C.
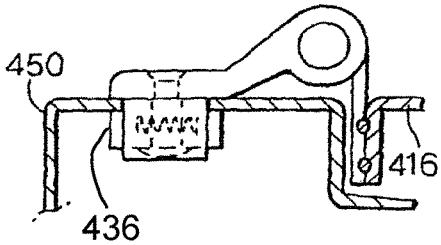
Fig.10A.
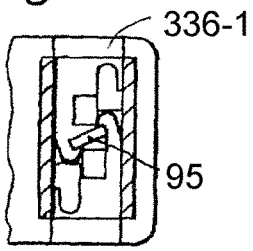
Fig.10B.
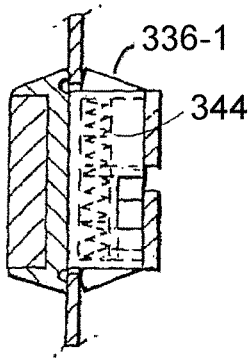
Fig.12.
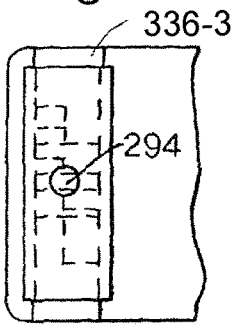
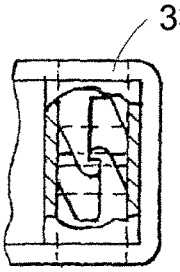
Fig.11.

CLIP FIXING ELEMENT FOR THE ASSEMBLY OF FIXTURE DEVICES SUCH AS LOCKS, HINGE PARTS AND HANDLES IN OPENINGS IN A THIN WALL

CROSS-REFERENCE TO RELATED APPLICATIONS

This application claims priority of International Application No. PCT/EP2005/000728, filed Jan. 26, 2005, German Application No. 20 2004 001 161.1, filed Jan. 26, 2004 and German Application No. 20 2004 003 238.4, filed Feb. 27, 2004, the complete disclosures of which are hereby incorporated by reference.

BACKGROUND OF THE INVENTION a) Field of the Invention

The invention is directed to a snap fastening for mounting fittings such as socket wrench latches, swivel lever latches, sash latches, bar latches, hinge parts, handles, fixing brackets for door stops or flap supports in openings in a thin wall, comprising a head part which is to be arranged on one, outer side of the thin wall and which overlaps the outer rim of the opening, and a body part which proceeds from the head part in the mounted position and projects through the opening, and holding elements which project from the body part and are flexible in direction of the outer surface of the body part, the free end of these holding elements being provided with an inclined surface for supporting the body part without play on the rim of the opening of the other, inner side of the thin wall.

b) Description of the Related Art

U.S. Pat. No. 5,435,159 discloses a snap fastening for quick mounting of a lock housing which can be arranged, for example, in a round opening in a thin wall. The housing which is intended for a sash latch comprises a head part, namely, a flange, which is to be arranged on one, outer side of the thin wall and which overlaps the outer rim of the opening, a body part which projects through the opening in the mounted position proceeds from this head part, and tongue elements which are flexible in the direction of the outer surface of the body part project from the body part and have an inclined surface at their free ends for supporting the body part without play on the rim of the opening of the other, inner side of the thin wall. The holding force of the holding elements or tongue elements which are formed integral with the body part depends upon their spring tension, which depends upon the plastic material that is used, and therefore this holding force cannot be made as high as might be desired.

EP 0258491 A1 discloses a similar construction by which a lock cylinder can be fastened in thin-walled doors, drawers or the like by means of a plastic housing which receives the lock cylinder and which forms holding tongues. By means of inclined surfaces at the ends of the tongues it is possible to adapt in a desirable manner to commonly occurring variations of the structural component parts to be locked. It is also stated in column 9 of the reference that the springing tongues can no longer deflect inward after the lock cylinder is mounted in the housing. This has the disadvantage that a very particular design, namely, a round housing with a lock cylinder inserted therein, must be provided in order to allow the tongues to be locked in this way after mounting.

OBJECT AND SUMMARY OF THE INVENTION

The primary object of the invention is to provide a further development of the known arrangement which can be mounted simply by inserting it into the opening, can be used in a versatile manner, can be disassembled only with difficulty, or not at all, without a tool, and which makes do without parts that can be lost such as screws or nuts, withstands vibrations, and has a greater holding force.

The object of achieving increased sturdiness is met in that the body part and holding element and the spring which reduces the spring force are separate parts.

This makes it possible to provide a snap fastening for quick mounting of fittings such as swivel lever latches, hinge parts, cylinder housings, handles, and the like in openings in a thin wall for fittings of any shape in principle, that is, not only for round lock cylinders, whose holding force does not depend on the plastic material used for the tongues, can accordingly have any desired magnitude in theory, and can be adapted to the task at hand.

In the simplest embodiment form, the body part and head part are injection molded in one piece, for example, from plastic. However, it is also possible to construct the body part and head part as two parts which are screwed, welded, glued or even snapped together.

According to a further development, supporting elements are provided in the body part and are held or carried by the latter for supporting the holding elements after the fitting is mounted in the thin wall.

According to another further development of the invention, two holding elements which are arranged diametrically opposite from one another are provided and are supported by spring arrangements such as spiral springs. Since the stop bevels of the holding elements can be provided with different angles and since the spring arrangements can be provided with spring force that, in itself, can be freely selected, the locking force can be adapted to the task at hand and does not depend upon the plastic material.

In the prior art, the locking force depends extensively upon the shape of the fitting and upon the material characteristics of the plastic that is, used.

According to a further development of the invention, the holding elements are levers which are arranged at a distance from the thin wall so as to be rotatable around an axis parallel to the plane of the thin wall such as the door leaf plane. Alternatively, the holding elements are levers which are arranged at a distance from the door leaf plane so as to be swivelable around an axis perpendicular to the door leaf plane.

According to another alternative, the holding elements are slides which are arranged so as to be displaceable in a cylinder that lies parallel to the door leaf plane and is rectangular in cross section. These slides can be held against the force of a pressure spring by a locking hook arrangement arranged between the slides.

When the two diametrically oppositely arranged holding elements are loaded to different extents, such as when a sash is used, it is advantageous when the locking part upon which the smaller load is exerted is made of flexible plastic such as polyamide and the other locking part upon which the greater load is exerted is made of metal.

Another embodiment form is characterized in that the holding elements are slides comprising a rigid material such as metal which are arranged so as to be displaceable in a cylinder which is parallel to the door leaf plane and is rectangular in cross section and are held against the force of a pressure spring by a pin arrangement that is arranged between the slides.

The pin arrangement can also comprise screws that are screwed into the head part, and it is possible, according to another embodiment form, for the screws to fasten the body part to the head part.

The cylinder can have a partial dividing wall or undercut or opening edge at which slides are supported axially by a shoulder or hook.

Another embodiment form, in which the fitting is a swivel lever latch or a folding lever latch for fastening in an elongated opening or in two shorter rectangular openings, wherein one opening receives the lever bearing, e.g., the drive shaft, and the other opening receives a lever stop, is characterized in that at least one of the openings also serves to receive at least one holding element according to one of the preceding embodiment forms.

In particular, the swivel lever latch can have a dish or trough for receiving the actuating lever in a lockable manner, and, according to the invention, the trough forms the head part of one or two holding elements in the area of the lever bearing such as a drive shaft.

The swivel lever latch can have a trough for receiving the actuating lever in a lockable manner and is characterized in that the trough forms the surface behind which the cam of a lever stop engages on the one hand and forms the head part of a holding element in the area of the lever stop on the other hand.

When a trough is used, it is advantageous, when the holding elements are formed by slides which are held so as to be displaceable and whose movement axis lies perpendicular to the longitudinal extension of the trough.

The fitting can also be a hinge part.

BRIEF DESCRIPTION OF THE DRAWINGS

The invention will be explained more fully in the following with reference to embodiment examples shown in the drawings.

FIG. 2 shows a partial view of an embodiment form with another lever lock;

FIG. 3 is a view similar to that in FIG. 1C showing an alternative embodiment form of the snap-like holding element;

FIGS. 9A, 9B and 9C show three different views of an alternative embodiment form of a hinge device which can be partly snapped in and partly welded;

FIGS. 10A and 10B show different views of another embodiment form;

FIG. 11 shows another embodiment form;

FIG. 12 shows still another embodiment form;

FIGS. 49A to 49D show different views of the lock case according to FIG. 46 which is installed in a wall and with associated cover for the second opening that can be snapped in;

FIGS. 72, 73, 74 show different views of a metal hinge with guide channels which are welded on;

FIGS. 88A to 88C show three different views of an embodiment form in which a guide channel is formed through a top that is screwed on.

DESCRIPTION OF THE PREFERRED EMBODIMENTS

Figure 1A:
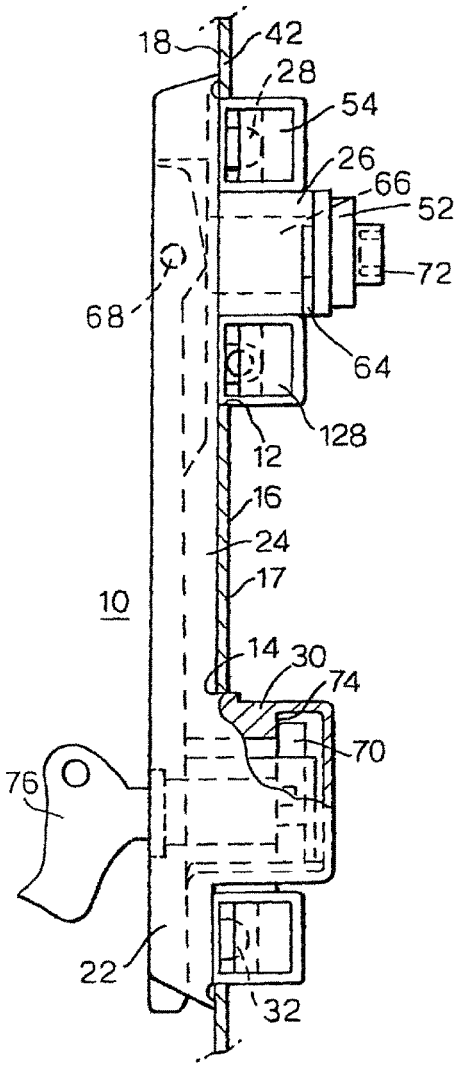
FIG. 1A shows an axial section through a trough for a swivel lever latch in which the snap fastening according to the invention is used.
Figure 27:
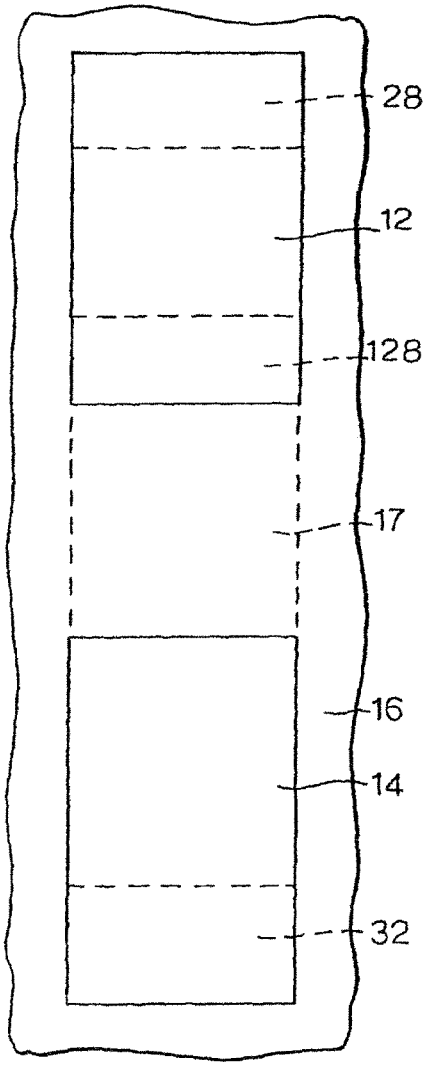
FIG. 27 shows two openings in which a swivel lever latch according to FIGS. 1A, 1B with snap devices can be installed.

FIG. 1A shows a longitudinal section through a swivel lever latch 10 as an example of a fastening of a fitting according to the invention. The swivel lever latch 10 is arranged in two rectangular openings 12, 14 of a thin wall 16 which, in the present instance, is part of a sheet-metal cabinet door leaf, see also FIG. 27. When the center web 17 is omitted, a long rectangular opening results. This would also be suitable.

In the area of each opening 12 and 14, the fitting, in this instance a swivel lever latch, comprises a head part, in the present instance a trough 24, that receives the swivel lever 22. This head part is to be arranged on one, outer side 18 of the thin wall 16 and overlaps the outer rim 20 of the opening 12 and 14, respectively. A body part 26 which projects through the opening 12 and 14, respectively, in the mounted position proceeds from this head part or trough 24. As is shown in FIG. 1C, tongue elements or holding elements 36 which are flexible in direction of the outer surface 34 project from this body part 26, their free ends having an inclined surface 38 for supporting the body part 26, 28 on the rim or edge 40 of the opening 12 and 14, respectively, of the other, inner side 42 of the thin wall 16 without play.

Figure 1B:
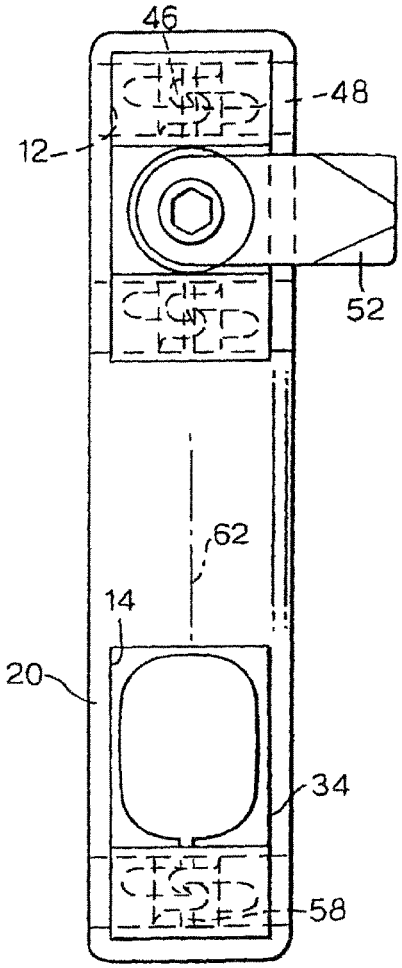
FIG. 1B shows a rear view through the trough which is fastened to the snap fastening according to the invention.

The body parts 28, 32 proceeding from the head part, that is, from the trough 24 in the present instance, have holding elements 36 which are displaceable against any force of a spring 44 in the body part 26. These holding elements are held by locking elements 46, 48 after being mounted in the body part. FIG. 1B shows that the locking elements are hooks which hook in one another. The material of these hooks advisably comprises polyamide, that is, they are flexible enough that when the holding elements 36 move linearly in the body part 26, 28 they can deflect to a sufficient degree and move past one another and spring back so as to hook into one another so as to be fastened on the top and bottom with reference to FIG. 1B, so that they remain in the position shown in FIG. 1B, and the body parts 32, 28, 128 proceeding from the trough 24 are accordingly securely held in the associated rectangular opening. This locking can be so designed by means of spring arrangements 44 of corresponding force that the holding elements or snap elements 36 do not move back against the force of the spring 44 under normal circumstances and operating conditions.

When the latch, as in the present case, comprises a sash tongue 52 located behind a door frame bevel 50, the two holding elements 36, 136 located diametrically opposite one another are loaded to different degrees. The pressure exerted on the tongue 52 in its position in which it engages from behind is absorbed for the most part by the rim 20 of the sash trough located opposite the holding element 36, while a smaller load is exerted on the holding element 36, whereas on the opposite side the reverse is true because the greatest load is exerted on this holding element 136. In order to take this varying load into account, it can be useful when the snap element 136 bearing the greater load is made of metal and not of plastic. Since, at the same time, the holding element 36 on which the smaller load is exerted is made of a plastic such as polyamide, this holding element remains flexible and is therefore able to move back in a springing manner when the two holding elements 36, 136 move in and lock together.

Figure 1C:
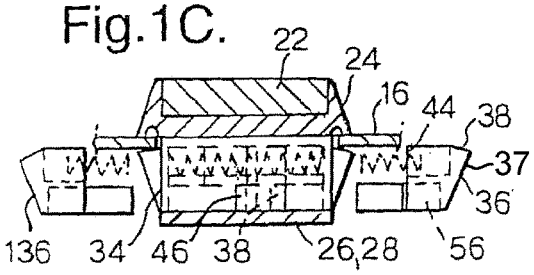
FIG. 1C shows, a cross section through the snap fastening for the trough according to FIGS. 1A and 1B.
Figure 1D:
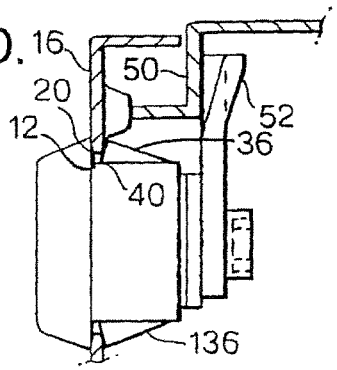
FIG. 1D shows a top view of the trough according to FIGS. 1A and 1B.
Figure 4A:
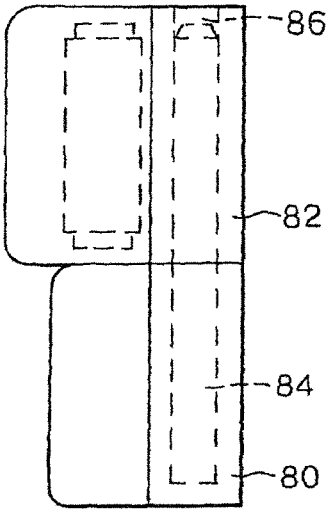
FIG. 4A is a top view of a hinge provided with the snap fastening according to the invention.
Figure 4B:
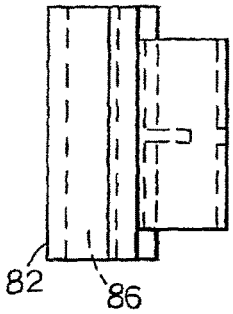
FIG. 4B shows the top hinge part from FIG. 4A with details of the snap device of the hinge according to FIG. 4A.
Figure 4C:
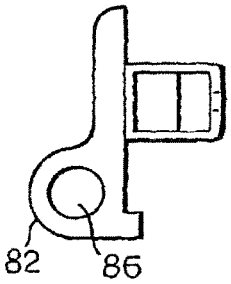
FIG. 4C is atop view of the hinge part according to FIG. 4B.

In the embodiment form according to FIG. 1C, the two locking parts 36, 136 are slides 56 which are arranged so as to be displaceable parallel to the door leaf plane in a cylinder which is rectangular in cross section, these slides 56 being held against the force of two pressure springs 44 supported at a central wall 58 by a locking hook arrangement 46, 38 which is arranged between these slides 56. In the embodiment form according to FIG. 3, the arrangement is designed in such a way that the holding elements 236 are levers 236-1 which are arranged at a distance A from the door leaf plane 16 so as to be rotatable around an axis 60 parallel to the door leaf plane.

The two levers 236-1 are each pressed outward at their inner end by a shared, strong pressure spring 244.

By means of the snap devices, it is possible to mount the lever latch in the thin wall simply by pressing it into two suitably shaped rectangular openings in that edges of the two openings 14, 12 lying in direction of the trough axis 62 press the contacting inclined surfaces of the holding elements 36, 136, 236 inward against the force of the springs 44, 144, 244 when pushing in and allow them to spring back when the inclined surface 38 is reached, thereby securing the trough in the door leaf.

With regard to the construction of the swivel lever latch, the tongue may be provided with a rotatable cross stop, indicated at 64, in order to convert the swivel lever to right-handed operation or left-handed operation. A bar lock body with pinion and bar stop which is connected to the trough can also be mounted and snapped in, particularly when the center web 17 between the two openings 12, 14 in the thin wall 16 is omitted resulting in an elongated opening comprising openings 12, 14 (see FIG. 27).

As can be seen from FIGS. 1A and 1B, the top body part 26 projecting from the trough 14 serves as a bearing for a drive shaft 66, the hand lever 22 being articulated at the end of the drive shaft 66 located outside of the door leaf so as to be swivelable around an axis 68 perpendicular to the door leaf plane, while the inner end of the shaft 66 terminates by a square, a tongue 52 having a square opening being mounted on this inner end and held by means of a fastening screw 72.

A holding element 28, 128 adjoins the bearing block for the shaft 68 at the top and/or at the bottom. The holding elements and the bearing block together make up the dimensions for the passage through the rectangular opening in the door leaf.

At the lower end of the trough, a receiving area 30 for a cylinder lock locking part proceeding from the hand lever 22 is provided with an eccentrically moving tongue or cam 70 which can be locked behind an offset surface 74 by actuating a cylinder key 76 in the folded in position.

Alternatively, as is shown in FIG. 2, a spring engaging element 174 is provided so that a folding in movement and locking can be carried out when the key is removed, and the rotating tongue 170 could also be mountable on the cylinder roller so as to be rigid against rotation by means of the snap devices.

FIG. 4 and the following figures show an embodiment form in which the snap fastening according to the invention is applied in a hinge. FIGS. 4A and 4D, for example, show a two-part hinge with hinge parts 80, 82. The bottom, first hinge part 80 is fastened to the door frame 250 by the snap element 336 which is described in connection with the swivel lever handle, while the second, top hinge part 82 is connected to the door leaf by means of the holding element 236 (see FIG. 4D).

The bottom hinge part 80 and the top hinge part 82 are connected to one another by a hinge pin 84 which is securely press-fitted in the bottom hinge part 80, while its top end is received in a bore hole 86 of the top hinge part 82 so as to be rotatable. The bottom hinge part 80 is connected to a door frame 150, namely, by means of a snap fastening 228, while the top hinge part 82 holds a sheet-metal door 216 by means of the snap fastening 232 such that it is swivelable around the axis of the hinge pin 84.

Figure 13:
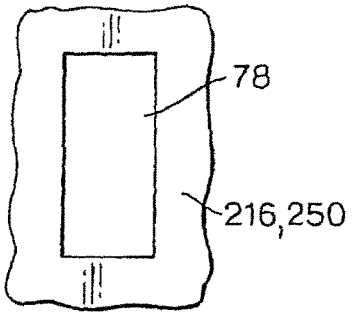
FIG. 13 shows an opening in which a hinge with the snap device can be installed, e.g., according to FIGS. 14A and 14B.

The rectangular opening required in the door frame 250 and in the door leaf 216, for this purpose is shown, for example, in FIG. 13 by reference number 78. In this case also, the snap fastening comprises a head part or hinge tab 88 which is to be arranged on the outer side of the thin wall or of the frame 250 and door leaf device 216 and overlaps the outer rim of the opening 78. A body part 228 which projects through the opening 78 in the mounted position proceeds from this head part or hinge tab 88. Holding elements or tongue elements 336 project from the body part 228 and are flexible in direction of its outer surface, an inclined surface 38 being arranged at their free ends for supporting the body part 228 and, therefore, the hinge 80 without play on the rim of the opening 78 of the other, inner side of the thin wall 250. This also applies to the hinge part 82 and the door leaf 216.

Figure 5A:
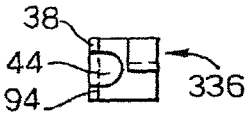
FIGS. 5A, 5B and 5C show different views of the holding elements used in the embodiment form according to FIG. 4A.
Figure 4D:
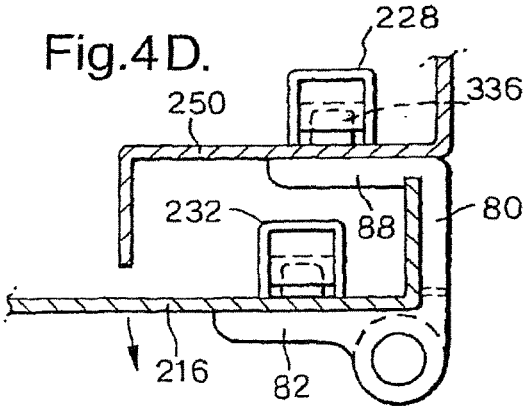
FIG. 4D shows the two hinge parts of FIG. 4A with the snap fastening for use in a cabinet of sheet-metal material.
Figure 5B:
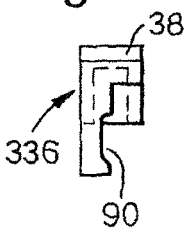
Figure 5C:
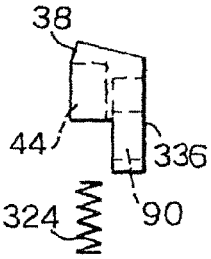
Figure 6:
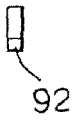
FIG. 6 shows the holding pin which is used in the holding elements according to FIG. 5.
Figure 7A:
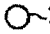
FIGS. 7A and 7B show two different views of the springs, two of these springs being used in the snap device.
Figure 7B:
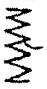
Figure 8B:
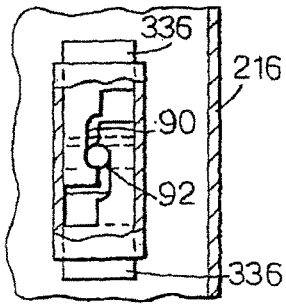
FIGS. 8A and 8B show two different views of the snap device that can be used in the hinge according to FIG. 4A.
Figure 8A:
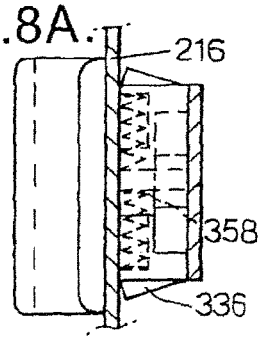

A design such as was already described in connection with the swivel lever latch or such as that shown in the embodiment form according to FIGS. 5A to 5C can be selected for fastening the hinge. In this case, a pin according to FIG. 6 is used for locking instead of the hooks. Two structural component parts made of metal according to FIGS. 5A to 5C are inserted into a rectangular guide channel according to FIG. 8B and are held in the inserted position in such a way by means of a pin, according to FIG. 6, which is screwed in from the outside, that these structural component parts can move relative to one another by a short distance but cannot fall out. This is achieved by means of the offset 90, which provides a path along which one half of the width of the pin 92 can run, and by the spiral spring 344 which is supported in an opening 94 of the part 336 on one side and on an intermediate wall 358 on the other side. The part 336 is shaped symmetrically such that it permits the mounting possibility according to FIGS. 8A and 8B.

FIGS. 9A, 9B and 9C show an embodiment form for a hinge in which one hinge part is welded to the door leaf 416, while the other hinge part is held at the door frame 450 with another embodiment form of the snap fastening according to the invention. The latter comprises lever devices 436 which are arranged at a distance from the door leaf plane so as to be rotatable around an axis perpendicular to the door leaf plane and which are pressed outward by spring devices and then engage rim areas of a rectangular opening arranged in the door leaf 450.

FIGS. 10A and 10B show an embodiment form in which the two holding elements 336-1 which can be pressed apart by spring devices are held relative to one another by hooks between which a diagonally positioned wedge 95 is arranged. FIG. 11 shows a similar construction, 336-2.

A round pin 294 by which two parts 336-3 comprising a hard material such as metal which are displaceable relative to one another are held in position is provided in FIG. 12.

Figure 14A:
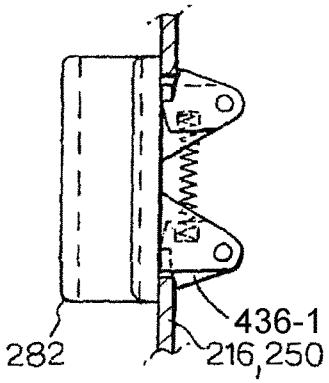
FIGS. 14A and 14B are two views of an alternative hinge.
Figure 14B:
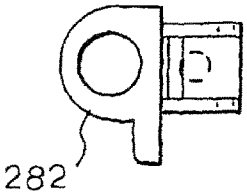

FIG. 13 shows a rectangular opening 78 which is suitable for locking in the construction described in this example. A hinge element, as is shown in a side view and a front view in FIGS. 14A and 14B, could be snapped into this rectangular opening 78. In other respects, the construction is similar to that shown in FIG. 3, although the present instance is directed to a (top) hinge part 282, including levers 436-1.

Figure 15A:
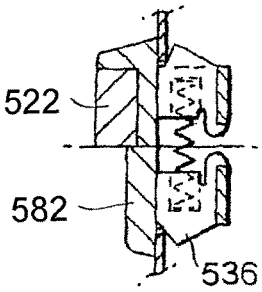
FIG. 15A shows a cross section through a fastening for a swivel lever latch in the upper part of the drawing and for a hinge part in the bottom part of the drawing.
Figure 15B:
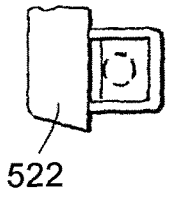
FIG. 15B is a top view of the arrangement according to FIG. 15A.
Figure 16:
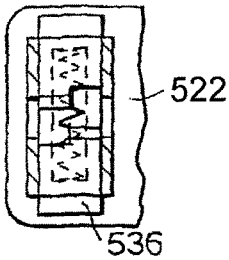
FIG. 16 is a view from the right-hand side of the object shown in FIG. 15A in the snapped in state.
Figure 17:
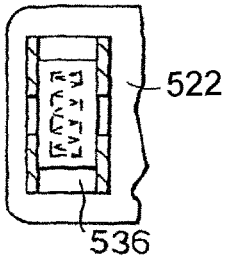
FIG. 17 shows the arrangement according to FIG. 16, but in the pushed back snap-in position.

FIGS. 15A, 15B, 16 and 17 show a fastening in which a swivel lever 522, in the top half of FIG. 15A, and a hinge part 582, in the bottom half of FIG. 15A, can be fastened in a rectangular opening of a thin wall. In this instance, an individual spring is provided which presses the two holding elements 536 out of the pressed back snap-in position, shown in FIG. 17, into the snapped in position according to FIG. 16 when the structural component part or fitting is pressed into the installation opening.

Figure 18A:
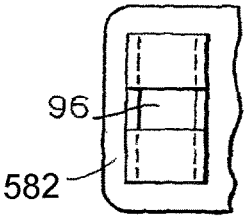
FIGS. 18A and 18B show two views of the individual part of the hinge tab.
Figure 18B:
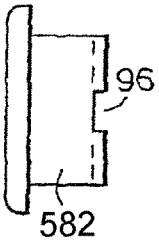
Figure 19A:
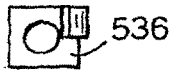
FIGS. 19A and 19B show two views of the holding element.
Figure 19B:
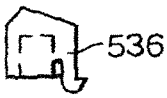
Figure 20:
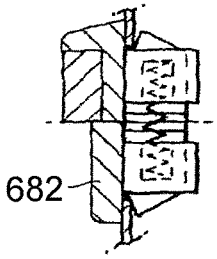
FIG. 20 shows another embodiment form in a view similar to that shown in FIG. 15A.
Figure 21:
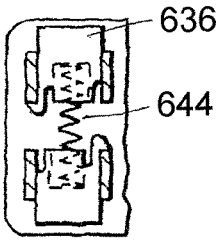
FIG. 21 shows the embodiment form according to FIG. 20 in the snapped-in state from the right-hand side.
Figure 22:
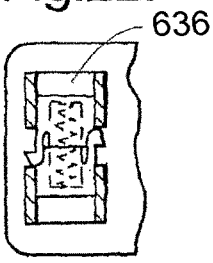
FIG. 22 shows the arrangement according to FIG. 21, but in the pushed back snap-in position.
Figure 23A:
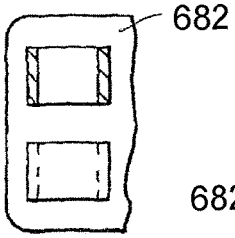
FIGS. 23A and 23B show views of the arrangement (hinge tab) according to FIG. 20 similar to those in FIGS. 18A, 18B.
Figure 23B:
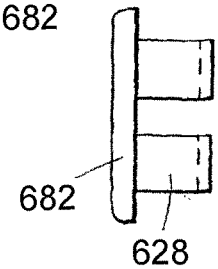
Figure 24:
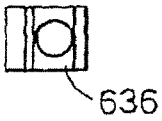
FIGS. 24 and 25 show two views of the associated holding element.
Figure 25:
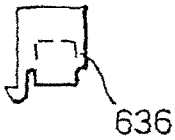

In FIGS. 19A and 19B, the two holding elements 536 are shown in detail in two different views. FIGS. 18A and 18B show the associated individual part as a hinge tab 582. It is significant that the hook of the holding element 536 is supported at a wall opening 96 in this case. Instead of the solution having the center web and the two springs which was described above, wherein the holding elements are held against one another, the present solution has one spring and an opening at the front in which the snap elements are held by hooks in the assembled delivered state. In the embodiment form shown in FIGS. 20, 21, 22, 23A, 23B, 24A, 24B, which is similar to the embodiment form according to FIGS. 15 to 19, a lateral opening is provided in the holding channel or guide channel instead of a front opening. The advantage in both cases consists in that only one spring is required.

Figure 26:
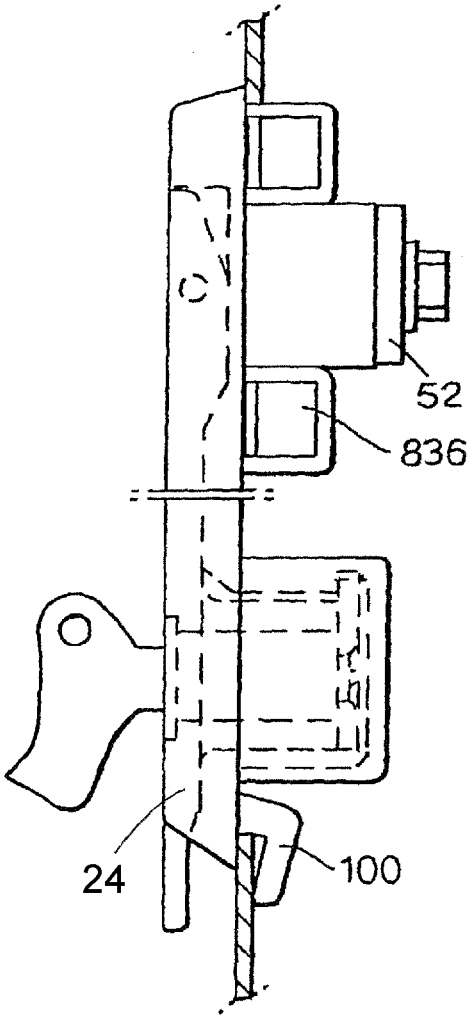
FIG. 26 shows an alternative embodiment form for a swivel lever latch in which only the top part is fastened with the snap device according to the invention, while the bottom part is fastened with a hook.
Figure 28:
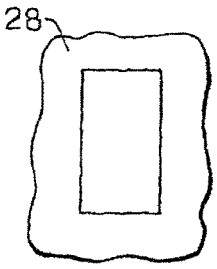
FIG. 28 shows an installation opening in a thin wall which fits the snap devices according to FIGS. 17 to 26.

FIG. 26 shows a swivel lever with a hook fastening, known per se, which is arranged at the bottom end. However, holding elements according to the invention are provided at the top end. Since only small forces act at the bottom end, referring to FIG. 26, a hook fastening by means of hooks 100 is sufficient, whereas in the tongue area 52, where the closing forces and the rotation of the hand lever bring about greater forces, the arrangement 836 according to the invention is provided in any of the above-mentioned embodiment forms.

In this way, the optimal type of fastening can be selected depending on the load.

Figure 29:
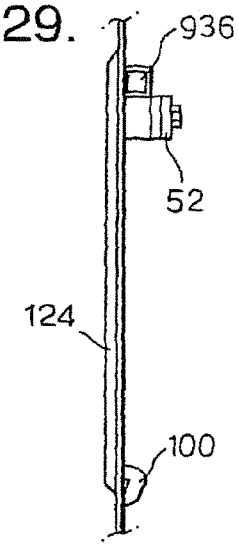
FIG. 29 is a side view of an embodiment form showing an escutcheon or key plate with pin actuation which can be fastened by means of a hook instead of a swivel lever latch according to FIG. 25.
Figure 30:
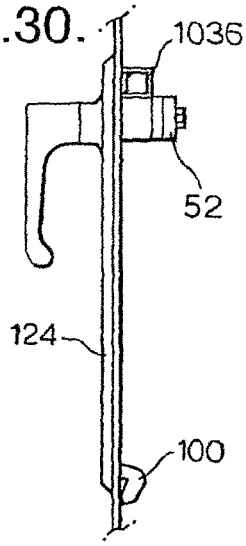
FIG. 30 is a view similar to that in FIG. 29 showing an arrangement with a handle lever actuation which is fastened by only one snap element at one end and by a hook at the other end.

While a top end is secured by two holding elements 836 in the swivel lever latch according to FIG. 26, only one holding element 1036 of this kind is provided in the embodiment forms according to FIG. 29 and FIG. 30.

In FIG. 26, a hook 100 is located at the other end of the key plate or head part 24. The embodiment form according to FIG. 29 shows a socket wrench latch, and the embodiment form according to FIG. 30 shows a lever latch.

Figure 31A:
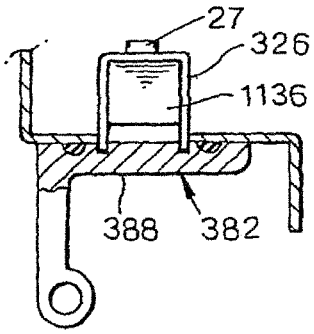
FIGS. 31A to 31C show different views of a fastening according to the invention for a hinge element, wherein the head part and body part are two pieces and are held together by screws.

FIG. 31A shows a sectional top view of a hinge part 382 in which the body part 326 is fastened by means of head screws 27 to the tab 388 forming the head part. At the same time, these screws 27 define the lift of the fastening elements 1136 (see elongated hole 29) within which the screw cross section 27 can move.

Figure 31B:
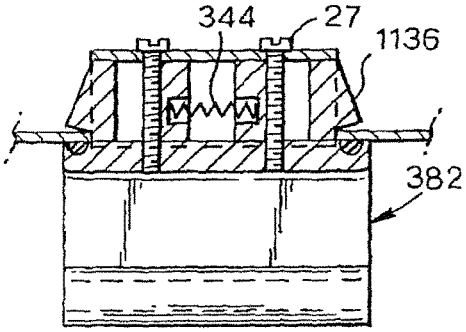
Figure 31C:
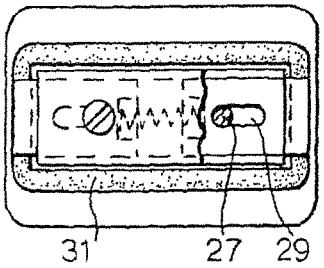

As follows from FIG. 31B or 31C, which show a bottom view in axial section, the elements 1136 move inward in the channel against the force of the spring 344 when inserting insofar as permitted by the elongated hole extension 29 and then jump again into the locking position shown in FIG. 31B. This separation of the head part and body part of the fastening system is advantageous, for example, when grooves 31 are to be provided for sealing rings 33. As a result of this, the tools for the injection molding process can be difficult to manage when it is desirable to manufacture a one-piece construction.

Figure 32A:
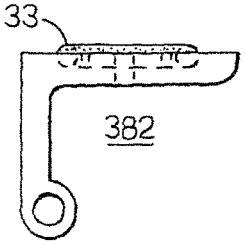
FIGS. 32A to 32C show three different views of the head part of the hinge element.
Figure 32B:
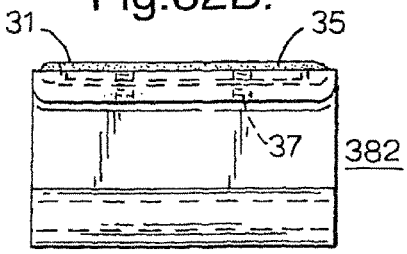
Figure 32C:
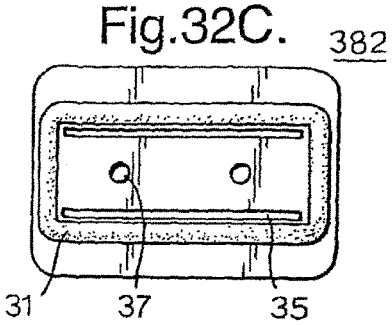
Figure 33A:
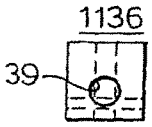
FIGS. 33A to 33C show three different views of the holding element used in this case.
Figure 33B:
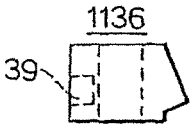
Figure 33C:
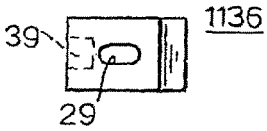
Figure 33D:
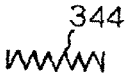
FIG. 33D shows the associated spiral pressure spring.

The hinge part 82 is shown in detail in FIGS. 32A, 32B and 32C in three different views. The drawings also show the groove 35 into which the free legs of the U-part 326 are inserted, as well as the threaded bore holes 37 into which the screws 27 can be screwed. The holding element which is used here is shown as an individual part in FIGS. 33A to 33C, including the receiving blind hole 39 for receiving a pressure spring 44.

Figure 34A:
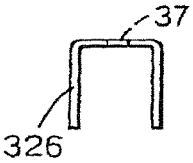
FIGS. 34A and 34B show two views of the U-shaped body part of the arrangement according to FIGS. 31A to 31C.
Figure 34B:
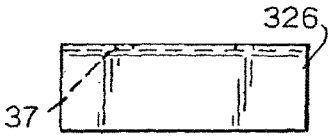

The guide part for the holding elements 1136 is shown in a front view and in a side view in FIGS. 34A and 34B.

Figure 35:
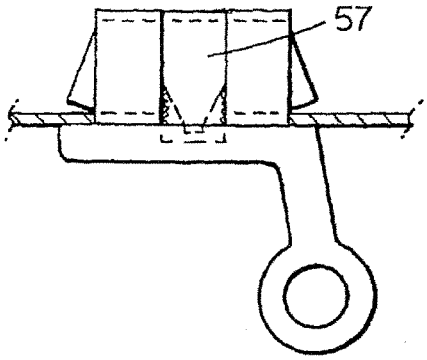
FIGS. 35 and 36 show a hinge component part which is fixed, according to the invention, at a door leaf and which also has a grounding spring arranged on it.
Figure 36:
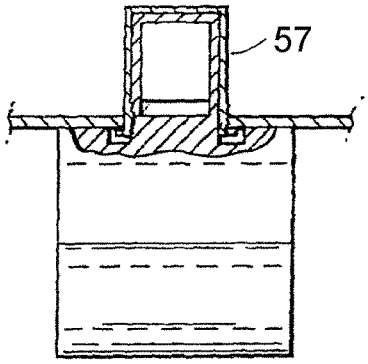
Figure 37:
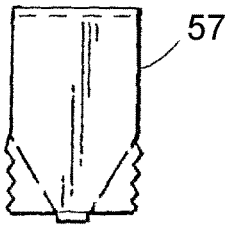
FIGS. 37 and 38 show two views of the associated grounding spring.
Figure 38:
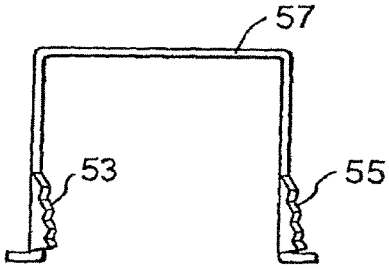
Figure 39:
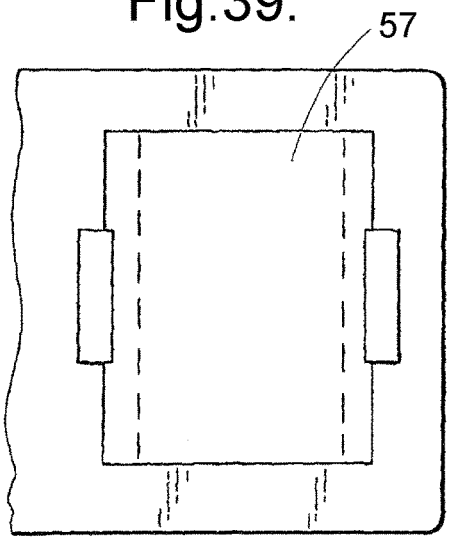
FIG. 39 shows a rear view of the door leaf with the installed hinge part with grounding spring.
Figure 40:
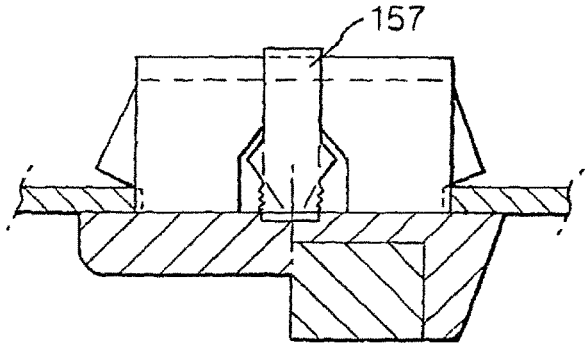
FIG. 40 shows two sectional views of a swivel lever trough and a hinge component part with fastening and grounding arrangement according to the invention.
Figure 41:
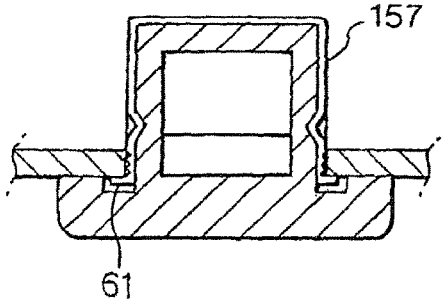
FIG. 41 shows another view of the arrangement according to FIG. 40.
Figure 42:
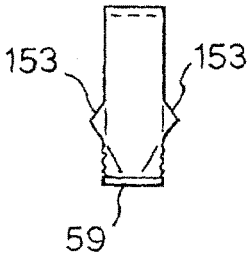
FIGS. 42, 43, 44 show two different views of the associated grounding spring.
Figure 43:
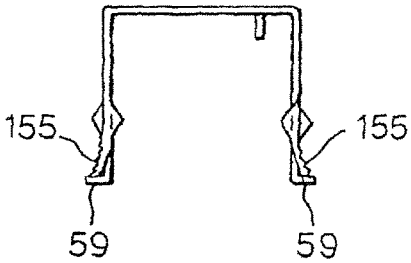
Figure 44:
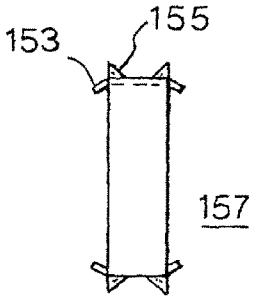

It can be seen from FIGS. 35, 36 that a grounding spring for hinges or latches can be arranged in the area of the guide channel for the snap elements, which provides for metal contact on each side, between the sheet-metal door or door leaf or frame on one side and the hinge or latch cap on the other side. To this end, the U-shaped spring 57 which is shown from the side and from the front in FIGS. 37 and 38 is outfitted with a toothing 53 which is directed inward toward the body of the body part of the fastening element and with a toothing which faces outward at 55 to make contact with the opening of the thin wall as is also shown in FIG. 39. A somewhat different construction for a grounding spring 157 is shown in FIG. 40 and in FIGS. 42, 43 and 44. A toothing 155 which faces outward makes contact with the sheet metal in a manner similar to that in the embodiment form just described, while the sharp edge tooth 153 contacts the body of the guide channel for the holding elements and makes electrical contact therewith.

As is clearly shown in FIG. 40, the grounding spring 157 is arranged centrally over the passage that is provided for the snap. The ends 59 of the spring are bent so as to remain in the grounding position. When passing through the opening, the upper tips 153 are each pressed flat and dig into the body part of the hinge body (FIG. 40, left-hand side) or the trough of a swivel lever latch (FIG. 40, right-hand side). However, this is only necessary when the parts are painted. As it continues to pass through, the bent out saw-teeth 155 scratch off the paint in the opening so that a good ground connection is made with the opening and the door leaf.

Figure 45:
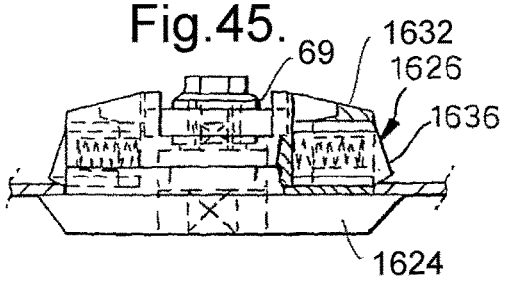
FIGS. 45 and 46 show two different sectional views of a socket wrench lock case with fastening, according to the invention, at the front sides of the lock case, with a cap supporting the nut and having snap arrangements which engage behind the bar.
Figure 46:
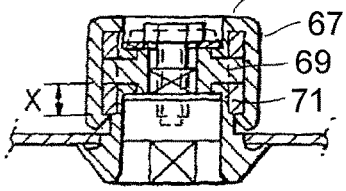
Figure 47A:
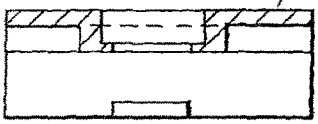
FIGS. 47A to 47C show two different detailed views of the lock case.
Figure 47B:
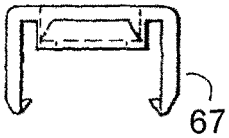
Figure 48A:
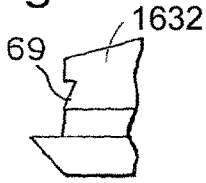
FIGS. 48A and 48B show an embodiment form with a cap which is held at the lock case.
Figure 48B:
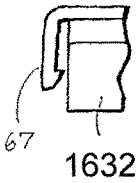
Figure 47C:
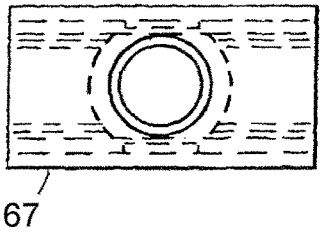
Figure 50:
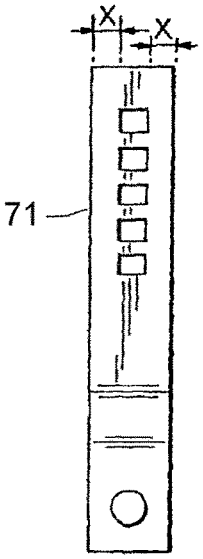
FIG. 50 shows the associated lock bar.
Figure 51A:
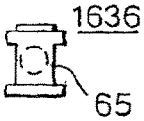
FIGS. 51A and 51B show two different views of the associated fastening element.
Figure 51B:
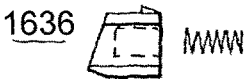
Figure 52A:
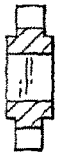
FIGS. 52A and 52B show two different views of the associated pinion.
Figure 52B:
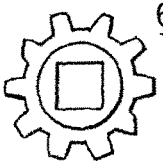
Figure 53:
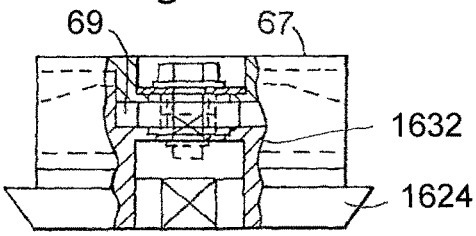
FIG. 53 shows the lock case with the cover arranged thereon.
Figure 49A:
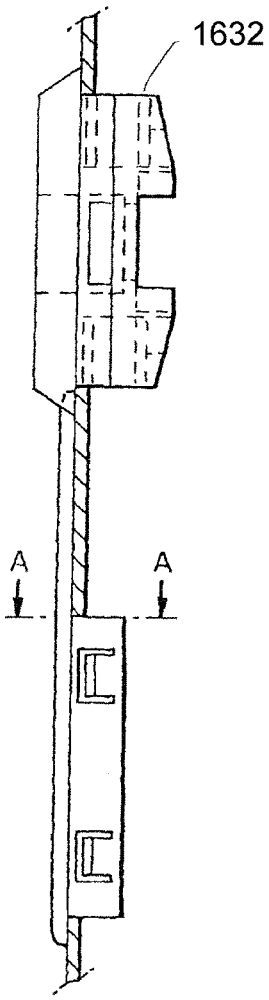
Figure 49B:
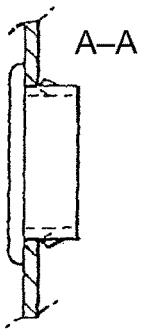
Figure 49C:
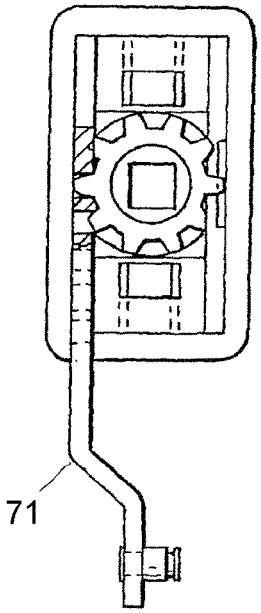
Figure 49D:
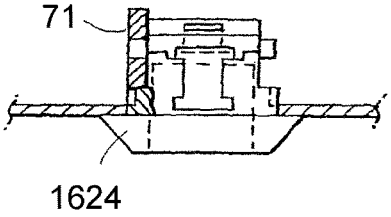
Figure 54A:
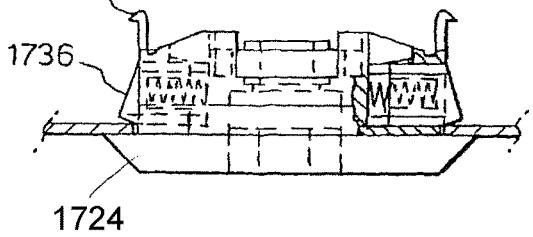
FIGS. 54A to 54C show different views of an embodiment form similar to that shown in FIG. 53, but in which the snap fastening for the cap engages at the front corners in openings.
Figure 54B:
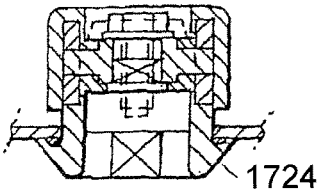
Figure 54C:
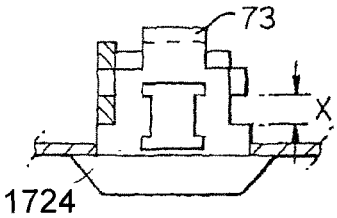
Figure 54D:
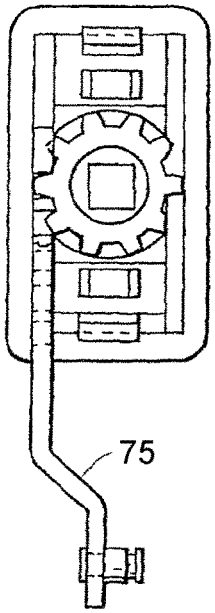

In the embodiment form according to FIGS. 45, 46, a fastening is provided by means of fastening elements (see reference number 1636) which are arranged in a channel. The fastening is carried out with holding elements 1636 which are arranged at the front sides and, since they are somewhat shorter than in other embodiment forms, are guided additionally through a groove shown at 65 (see FIGS. 51A, 51B), while the bearing support of the pinion 69 shown in FIGS. 52A, 52B is carried out in a body part 1632 shown in FIG. 45. Further, FIG. 53 shows a cover 67 which provides an additional bearing support for the pinion. This cover can be supported either at an offset 69 in the body part of the fitting (see FIGS. 48A, 48B) or at the edges of the latch bars 71 as can be seen in FIGS. 46 and 50. See also FIGS. 49A to 49D.

Figure 55A:
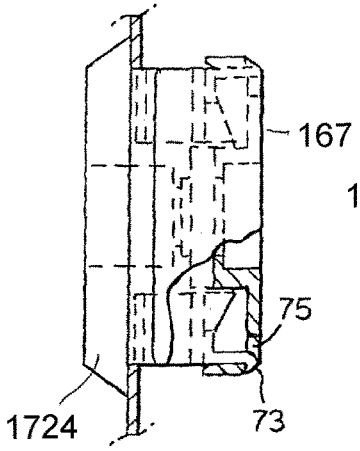
FIGS. 55A to 55D show different views of the lock case according to FIG. 54, but with the cover placed on it.
Figure 55B:
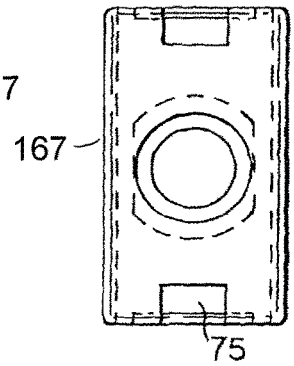
Figure 55C:
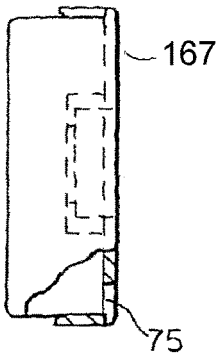

FIGS. 54A, 54B, 54C, 54D show a construction similar to that described above, but in this case the snap fastening for the cap is arranged at the front corners and the latter engage in openings that are formed by the cover which is shown in FIGS. 55A, 55B, 55C and 55D; that is, the hooks. 73 engage in the openings 75 shown in FIG. 55C resulting in the mounting shown in FIG. 55A.

Figure 56A:
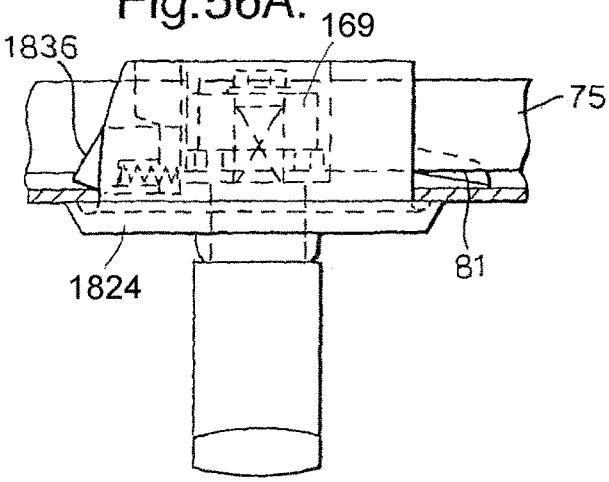
FIGS. 56A to 56B show two different views of a lever actuation with a lock case, wherein fastening is carried out with a hook arrangement on one side and, according to the invention, in a thin wall on the other side.
Figure 56B:
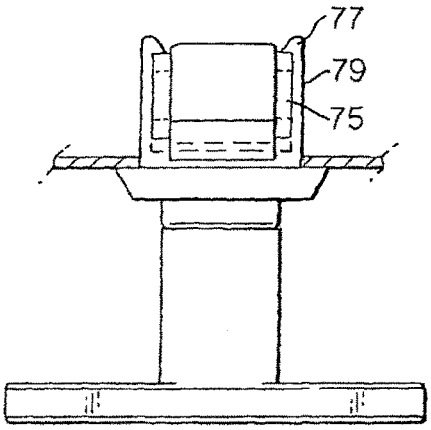
Figure 57A:
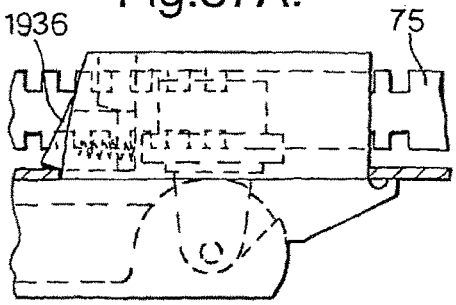
FIGS. 57A to 57C show a construction similar to that shown in FIG. 56, but with a swivel lever.
Figure 57B:
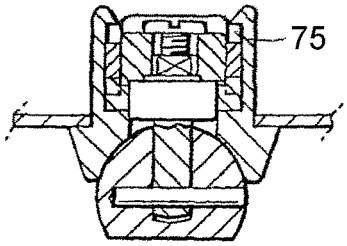
Figure 57C:
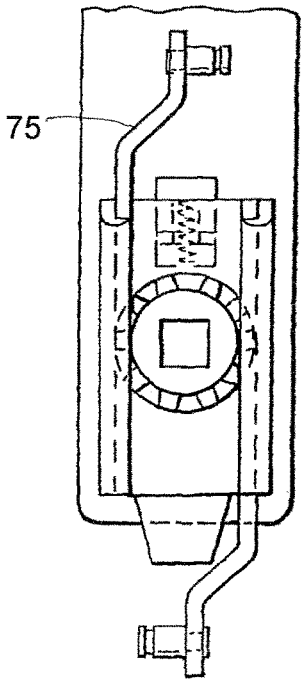

FIGS. 56A, 56B show a toggle latch with a latch bar 75 which operates without a cap and which has a one-part housing instead. Lateral guide webs 79 for the bars carry snap devices 77 and hold the bars in this way. The fastening of the housing is carried out by means of a hook 81 on one side (at right in FIG. 56A) and by means of the holding element arrangement 1836 according to the invention on the other side. FIGS. 57A to 57C show a similar construction, but in a swivel lever.

Figure 58A:
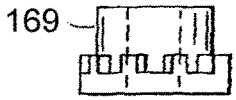
FIGS. 58A and 58B show two different views of the associated pinion.
Figure 55D:
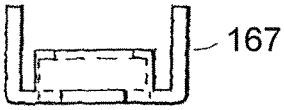
Figure 58B:
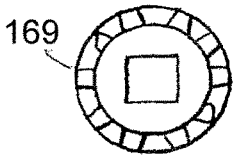
Figure 59A:
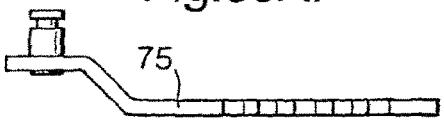
FIGS. 59A and 59B show two different views of the lock bar.
Figure 59B:
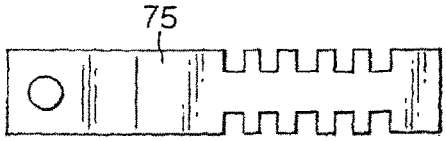
Figure 60:
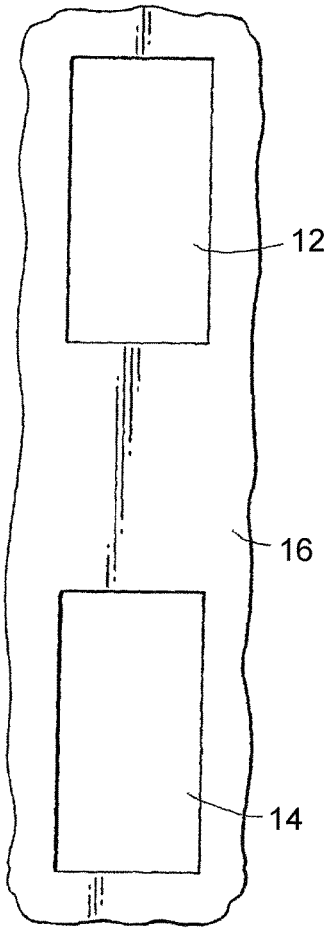
FIG. 60 shows the associated arrangement of openings in a thin wall.
Figure 61A:
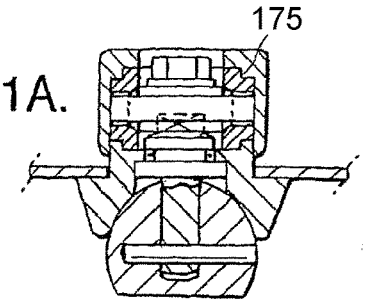
FIGS. 61A and 61B show a swivel lever latch with hooks with a snap element fastening, wherein the cap can be snapped on at the front side and the bar elements therefore provide for a particularly narrow construction, and the bar perforation is expanded at the end for mounting purposes.
Figure 61B:
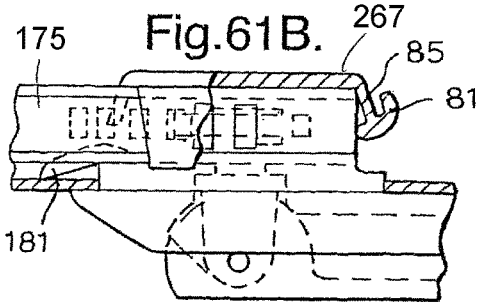
Figure 62A:
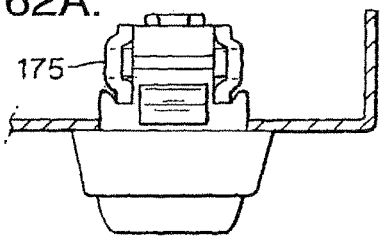
FIGS. 62A and 62B show a possible mounting scheme for locking bars.
Figure 62B:
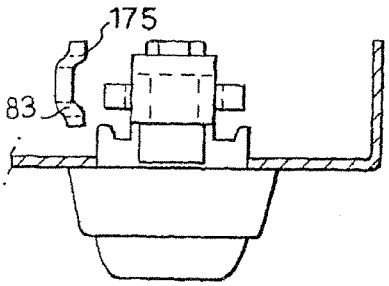
Figure 63:
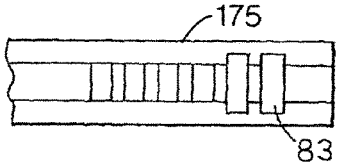
FIG. 63 shows a plan view of the locking bars.
Figure 64:
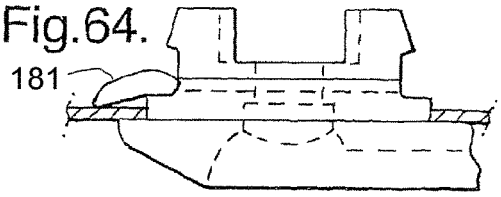
FIG. 64 shows a side view of the swivel lever trough.
Figure 65:
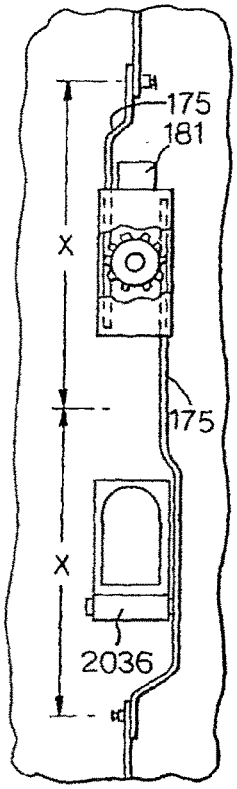
FIG. 65 shows the arrangement of lock parts in a door leaf.
Figure 66:
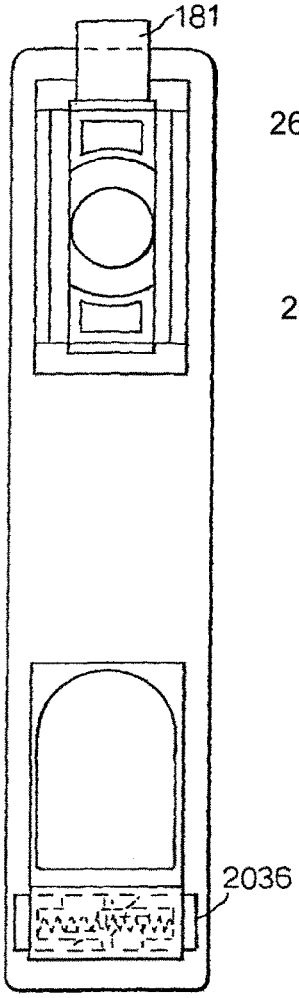
FIG. 66 is a bottom view of the swivel lever latch designed according to the invention.
Figure 67:
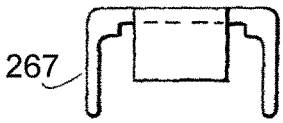
FIGS. 67 and 68 show two different views of the cover.
Figure 68:
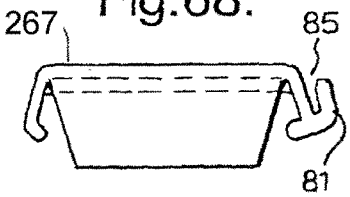
Figure 71A:
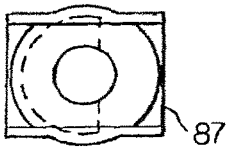
FIGS. 71A to 71C show the associated lock case cover.
Figure 71B:
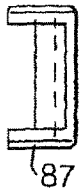
Figure 69A:
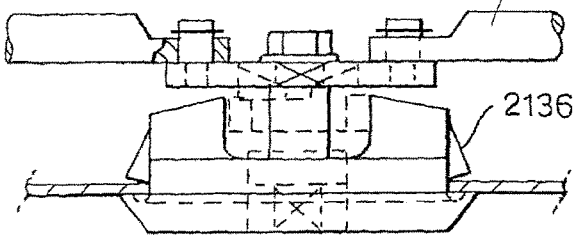
FIGS. 69A to 69C show three different views of a housing which can be snapped in according to the invention and to which is fitted an adapter for wing tongue application and for mounting round bars.
Figure 71C:
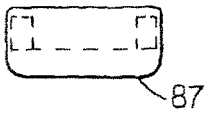
Figure 69B:
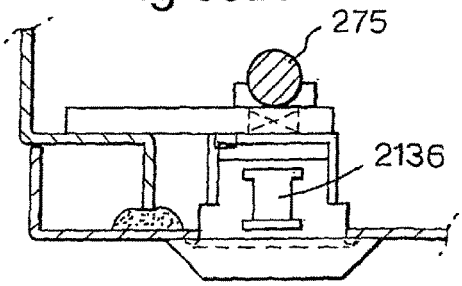
Figure 69C:
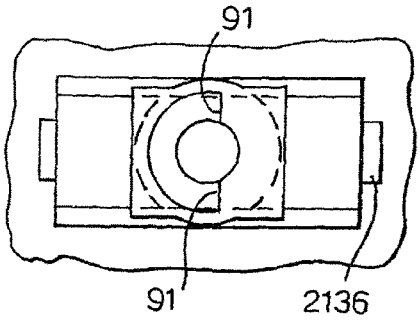
Figure 70A:
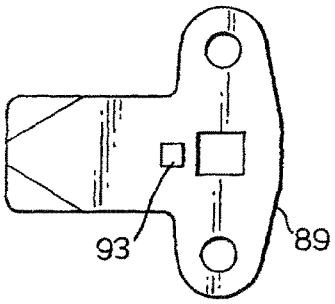
FIGS. 70A, 70B show two different views of the associated wing tongue.
Figure 70B:
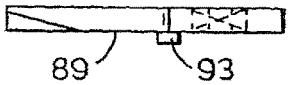

The bars 75 can be inserted from the top against the action of the snap device and engage with the pinion which is shown in more detail in FIGS. 58A and 58B. The bars according to FIGS. 59A, 59B have teeth on both sides to enable a reversal. The swivel lever latch shown in FIGS. 61A, 61B has a hook 181 at one end and a snap fastening according to the invention, 2036, at its other end (see FIG. 66). The cap of the lock case 267 can be snapped on at the front (see FIG. 61B, reference number 81). As can be seen in FIG. 62B, the bars 175 are bent in cross section on both sides resulting in a particularly narrow construction. The bar opening is widened at the end 83 to enable mounting according to FIGS. 62B, 62A. Disengagement of the snap closure of the cover at 81 is facilitated in that a slot 85 is provided in which a screwdriver is inserted so that the snap can be prized out. The embodiment form shown in FIGS. 69A, 69B shows a housing with fastening elements 2136 which is snapped in according to the invention. Mounted on the housing is an adapter 87, shown in FIGS. 71A, 71B, 71C, by means of which a wing tongue 89 shown in FIGS. 70A, 70B can be mounted. Round bars 275 are articulated at the wing tongue as is shown in FIGS. 69A, 69B. The adapter forms stop surfaces 91, see FIG. 69C, against which the protuberance 93 stops in order to limit the rotational path of the wing tongue 89.

Figure 72:
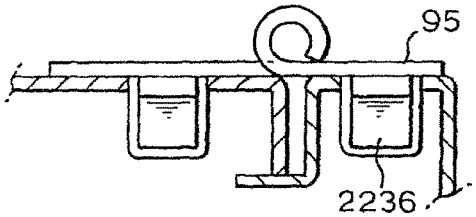
Figure 73:
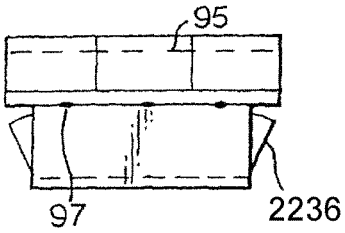
Figure 74:
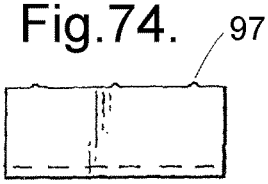
Figure 76A:
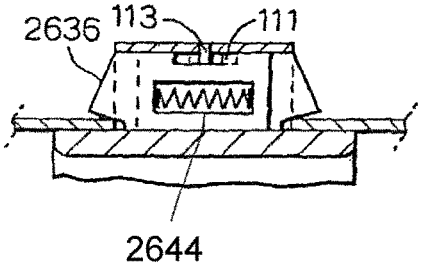
FIGS. 76A to 76C show three different views of a hinge according to the invention with a snap fastening.

FIGS. 72, 73, 74 show an embodiment form in which a holding device 2236 according to the invention is welded to a sheet-metal hinge 95. The welding is carried out by spot welding, see reference number 97.

Figure 75A:
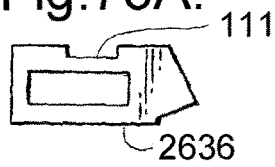
FIGS. 75A and 75B show two views of the slider associated with FIG. 76A.
Figure 75B:
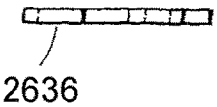
Figure 76B:
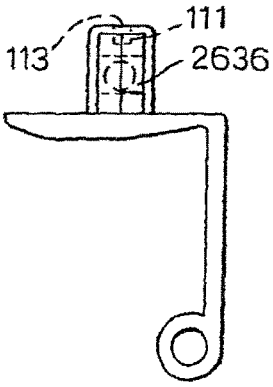
Figure 76C:
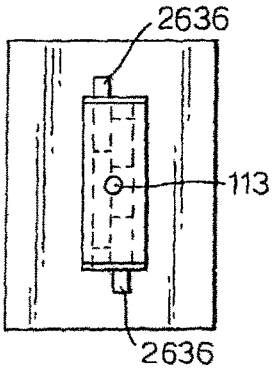
Figure 76D:
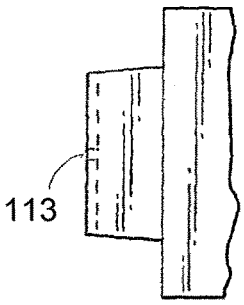
FIG. 76D shows another view.

FIGS. 76A, 76B, 76C, 76D, and 77 show another embodiment form of the invention in which two holding elements 2636 which are movable relative to one another are supported in a channel so as to be displaceable relative to one another against spring force. The movement of the elements 2636 is limited linearly by a notch 111 in which a headless screw 113 engages. The embodiment forms according to FIGS. 76A to 78C show an arrangement which is economical but also easy to mount. The flat sheet-metal parts to be used according to FIGS. 75A, B can be stamped cheaply. When installed, but not yet mounted on the cabinet sheet metal, the two openings of the sheet-metal parts are congruent even when the pressure spring is biased. The three parts, namely, the two snap plates and one pressure spring, which are biased, form a stable assembly in itself so that it can be inserted into the guide channel in a simple manner. The pin 113 which is then pressed in only prevents the unit from falling out. The snap plates do not develop a relative movement caused by the springs until mounted in the installation opening. The entire arrangement is very narrow and therefore saves space. In special situations, solitary snap plates can also be provided, and they can be bent to accommodate to cramped conditions.

Figure 78A:
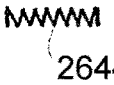
FIGS. 78A to 78C show the spring, a screw, and a pin as component parts of the fastening device according to FIGS. 76A to D.
Figure 78B:
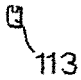
Figure 78C:
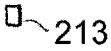

FIG. 78A shows the pressure spring 2644. FIG. 78B shows the headless screw 113. A pin 213 shown in 78C can also be used instead of the headless screw 113, but could not be disassembled.

Figure 77:
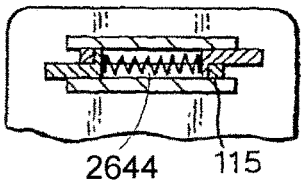
FIG. 77 shows still another view.

FIG. 77 shows how the parts can contact one another in the guide channel. An eversion 115 on one side for the opening makes possible a full-surface contact of the spring at the end.

Figure 79A:
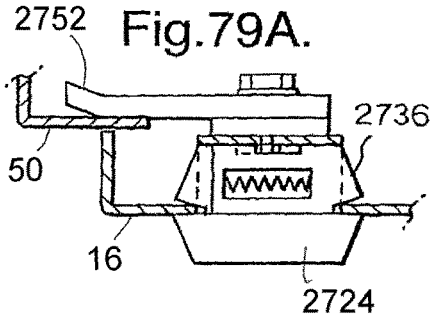
FIGS. 79A to 79C show three different views of a fastening element similar to that shown in FIGS. 76A to C, but in this case for a latch.
Figure 79B:
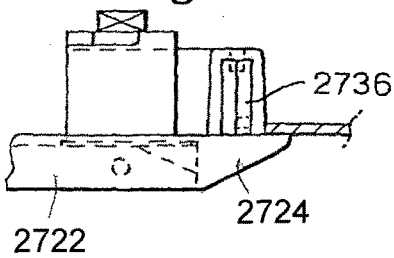
Figure 79C:
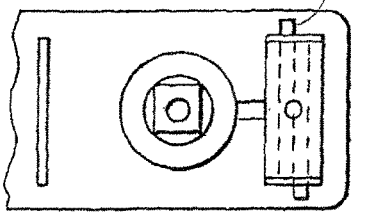

FIGS. 79A, 79B and 79C show a similar embodiment form in which the fastening 2736 according to the invention is used in a swivel lever. The swivel lever 2722 drives a sash 2752 which secures the door 16 in a frame 50 when the door is closed.

Figure 80A:
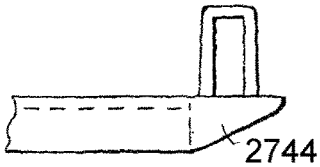
FIGS. 80A and 80B show detailed views of the latch trough with its fastening device.
Figure 80B:
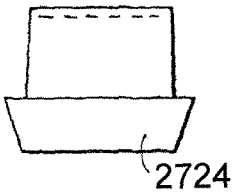
Figure 81A:
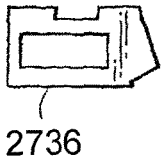
FIGS. 81A and 81B show two different detailed views of the slider.
Figure 81B:
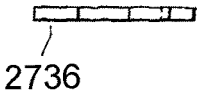

FIGS. 80A, 80B show details of the trough area to be placed in the door leaf, while FIGS. 81A, 81B show two views of the slider.

Figure 82A:
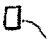
FIGS. 82A and 82B show a headless screw and a spring belonging to the latch according to FIGS. 79A to 79C in detail.
Figure 82B:
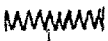

FIG. 82A again shows a headless screw 113, and FIG. 82B shows a wire spring 2744.

Figure 83A:
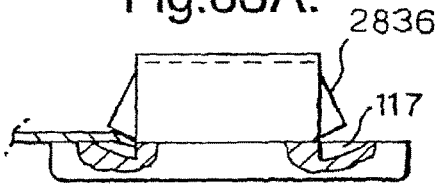
FIGS. 83A and 83B show two different views of a snap hinge in which sheet-metal bulges according to FIG. 84 are not detrimental.
Figure 83B:
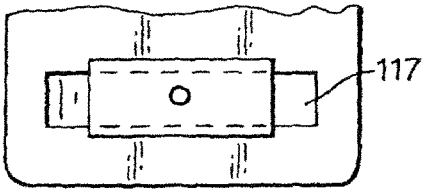

FIGS. 83A, 83B show an embodiment form which solves the problem that occurs when the loading of the snap elements at the sheet-metal edge is too high and causes an outward bulge. In this case, in the embodiment forms described above, the hinge leaf no longer makes clean contact. In order to solve this problem, an offset in which the bulge 119 is received is created in the area of the snap element on the inner side of the hinge leaf (see reference number 117). The snap element 2836 pushes forward, and secure fastening is still ensured without disadvantages.

Figure 84:
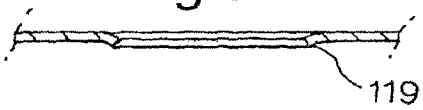
FIG. 84 shows the sheet-metal bulges at the rim of the opening.

FIG. 84 shows a sectional view, at 119, of the bulging sheet metal which can result from high loading at the high edges.

FIG. 83A is a side view of the channel construction with snap elements and offset. FIG. 83B shows a rear view of the channel construction without the snap pieces but with the offset for receiving the bulge.

Figure 85A:
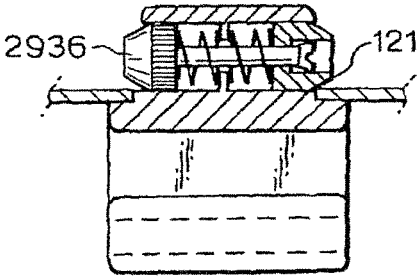
FIGS. 85A and 85B show two different views of a round bolt fastening part.
Figure 85B:
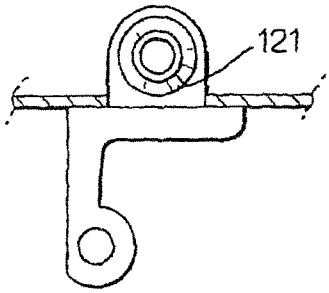

FIGS. 85A and 85B show an example for fastening a hinge part in an opening in a thin wall, that is, in a door or a sheet-metal frame, which works with a round bolt arrangement 2936. The round bolt fastening can probably not snap in because self-locking occurs. However, since the bolt surface 121 is relatively large on the outer side, the spring-mounted round parts can be pressed in with the fingers, and the part can then be inserted into the mounting opening. The desired wedging effect is achieved after passing through the mounting opening surface. Although there is only punctiform contact of the round parts, they are pushed forward by the spring if a round indentation should form.

Figure 86A:
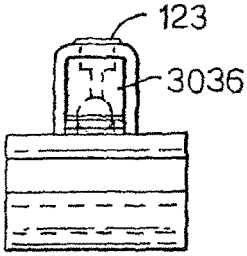
FIGS. 86A, 86B and 86C show three different views of another embodiment form of the invention.
Figure 86B:
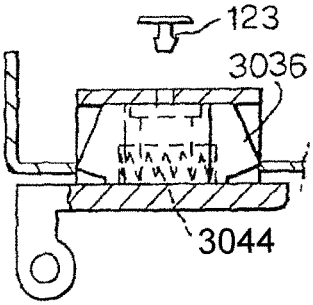
Figure 86C:
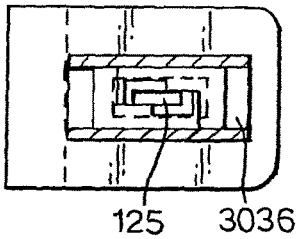
Figure 86D:
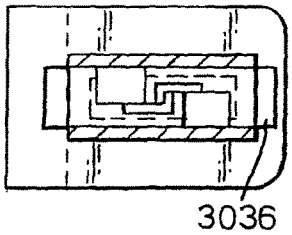
FIG. 86D shows a view similar to that in FIG. 86C, but with the holding elements moved out.
Figure 86E:
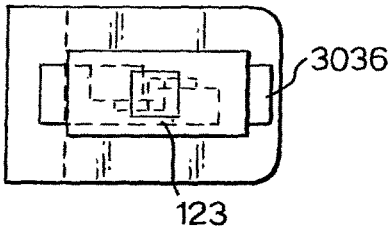
FIG. 86E is a view similar to that in FIG. 86D.

In the embodiment form shown in FIGS. 86A to 86C, the fixing plug 123 which engages in a slot 125 formed by the holding elements 3036 is not loaded by spring 3044 because the oppositely located holding elements 3036 hold one another mutually. The fixing plug 123 holds the holding elements 3036 only in the correct (center) position so as not to interfere with the snap-in process.

The construction enables simplified mounting, and only one spring 3044 is used because the center intermediate wall in the channel which was provided in the other embodiment forms is dispensed with in this case.

Figure 87A:
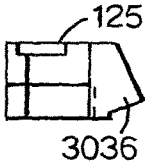
FIGS. 87A to 87C show three different detailed views of the holding element used in FIGS. 86A to 86E.
Figure 87B:
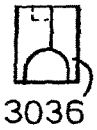
Figure 87C:
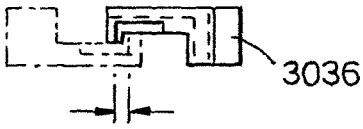

FIGS. 87A and 87C show the associated holding elements 3036 as individual parts.

Figure 88A:
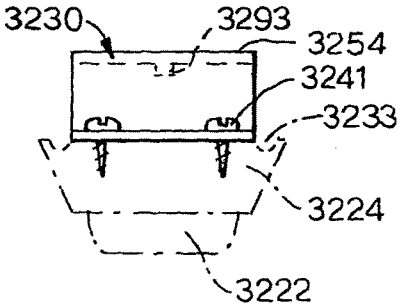
Figure 88B:
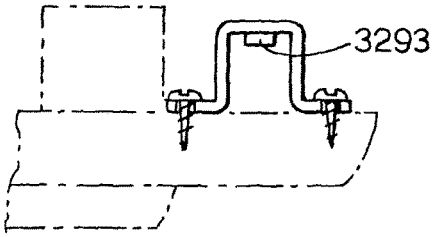
Figure 88C:
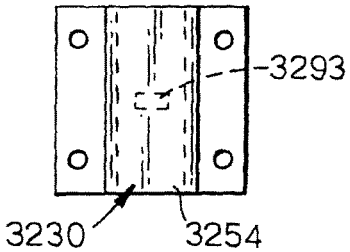

FIGS. 88A to 88C show three different views of a top 3230 which forms the guide channel and which can be screwed on. As regards tools or dies, this is advantageous for arranging channels 3231 for a seal 3233. It is not necessary to work with slides in the die. When the guide channel part is screwed on, the center fixing projection 3293 can be produced by pressing out (sheet-metal part) or casting (pressure die casting, plastic injection molding). The fixing plug 123 which was described in the preceding embodiment form (FIGS. 86A to 86E) would not be needed in this case.

Figure 89A:
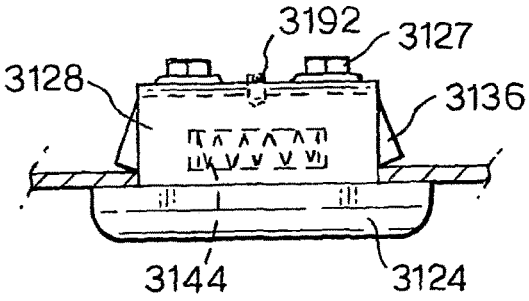
FIGS. 89A to 89C show three different views of an embodiment form for heavy loading in which four snap plates form the holding elements.
Figure 89B:
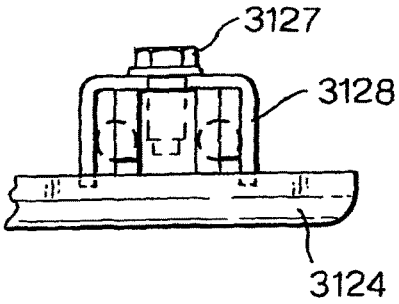
Figure 89C:
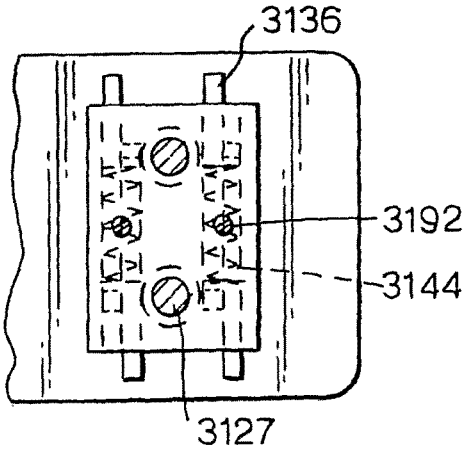

FIGS. 89A to 89C show three different views of an embodiment form in which a particularly heavy load capacity is achieved by an arrangement of four snap plates 3136. The U-part for forming the guide channel 3128 is screwed on in this instance. Supporting U-legs are recessed into the back side of the head part 3124. The snap plates move between the screw cylinders 3127 and in the inner wall of the U-part.

COMMERCIAL APPLICABILITY

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10 swivel lever latch
12 rectangular opening
13, 113, 213 pin, headless screw
14 rectangular opening
115 eversion
16, 216, 416 thin wall, door leaf (plane)
17 center web
18 outer rim of thin wall
20 outer rim of opening 16, 18
121 bolt surface
22, 122, 522, 2722, 3222 swivel lever, hand lever
123 fixing plug
24, 1624, 1724, 2724, 3124, 3224 head part, trough
125 slot
26, 326 body part
27, 3127 head screws
28, 128, 228, 3128 body part. guide channel
29 elongated hole
30, 3230 receiving area, top
31, 3231 grooves, channel
32, 1632 body part
33, 3233 sealing ring
34 outer surface
35 groove
36, 136, 236 (levers), 336, 436, 536, 636, 836, 936, 1036, 1136, 1536, 1636, 2736, 2836, 2936, 3036, 3136 tongue elements, holding elements, snap elements, locking elements
37 threaded bore hole
38 inclined surface
40 edge
3241 screw
42 inner side of thin wall
44, 144, 244, 344, 2644, 2744, 3044, 3144 spring
46 locking element
48 locking element
50, 150, 250, 450 door frame (bevel), thin wall
52, 2752 sash tongue, tongue area
53, 153 toothing
55, 155 toothing
56 slide
57, 157 u-shaped spring, grounding spring
59 end
60 axis (of lever)
62 axis (of trough)
64 cross stop
65 groove
66 drive shaft
67, 167, 267 cover
68 shaft
69, 169 pinion
71 latch bar
170 rotating tongue
72 fastening screw
74, 174 offset surface, spring engaging element
75 bar
76 cylinder key
77 snap device
78 opening
80 first hinge part
81 hook
82, 382, 582, 682 sec.ond hinge part
84 pin
86 bore hole
88, 388 hinge tab
90 offset
92, 3192 pin
3293 projection
94 opening
294 pin
95 wedge
100 hook No new matter was added by the above amendments.

What is claimed is:

1. A snap fastening suitable for mounting fittings in openings in a thin wall, comprising:

a head part which is to be arranged on one, outer side of the thin wall and which overlaps an outer rim of the opening;

a body part which proceeds from the head part and projects through the opening in the mounted position; and holding elements which project from the body part and are resilient in direction of the body part's outer surface against spring force, a free end of these holding elements being provided with a first inclined surface configured to support the body part without play on the rim or edge of the opening of the other, inner side of the thin wall, the free end further comprising a second inclined surface configured for slam action;

wherein said body part, holding element, and a spring generating the spring force are separate parts;

wherein said holding elements are slides which are arranged so as to be displaceable in a channel that is parallel to a plane of the thin wall and is rectangular in cross section, the channel having an inside rectangular cross-section orthogonal to the direction of the sliding movement of the slides;

wherein said holding elements are guided inside the channel having four inner walls as guiding surfaces, namely a head wall, two side walls, and a bottom wall, wherein the guiding surfaces of the four walls are flat and abut perpendicular to one another;

wherein said holding elements comprise two diametrically opposed holding elements having identical measures and being symmetrical with one another;

wherein said slides are held against pressure spring force by a hook arrangement locking between the slides or in the channel; and wherein the first inclined surface is inclined with respect to the plane of the thin wall at an acute angle of more than 0° and less than 90°.

2. The snap fastening according to claim 1;

wherein, when the two diametrically oppositely arranged holding elements are loaded to different extents, the holding element upon which the smaller load is exerted is made of flexible plastic and the other holding element, upon which the greater load is exerted, is made of rigid material.

3. A snap fastening suitable for mounting fittings in openings in a thin wall, comprising:

a head part which is to be arranged on one, outer side of the thin wall and which overlaps an outer rim of the opening;

a body part which proceeds from the head part and projects through the opening in the mounted position; and holding elements which project from the body part and are flexible in direction of the body part's outer surface against spring force, a free end of these holding elements being provided with a first inclined surface configured to support the body part without play on the rim or edge of the opening of the other, inner side of the thin wall, the free end further comprising a second inclined surface configured for slam action;

wherein said body part, holding element and a spring generating the spring force are separate parts;

wherein said holding elements are slides comprising a rigid material which are arranged so as to be displaceable in a channel which is parallel to a plane of the thin wall and is rectangular in cross section and being held against pressure spring force by a pin arrangement that is arranged between the slides; the channel having an inside rectangular cross-section orthogonal to the direction of the sliding movement of the slides;

wherein said holding elements are guided inside the channel having four inner walls as guiding surfaces, namely a head wall, two side walls, and a bottom wall, wherein the guiding surfaces of the four walls are flat and abut perpendicular to one another;

wherein said holding elements comprise two diametrically opposed holding elements having identical measures and being symmetrical with one another; and wherein the first inclined surface is inclined with respect to the plane of the thin wall at an acute angle of more than 0° and less than 90°.

4. The snap fastening according to claim 3;

wherein the pin arrangement comprises screws that can be screwed into the head part.

5. The snap fastening according to claim 4;

wherein the screws determine the extent of the movement of the holding elements.

6. The snap fastening according to claim 1;

wherein the cylinder has a partial dividing wall or undercut or opening edge at which slides are supported axially by a shoulder or hook.

7. The snap fastening according to claim 3;

wherein the cylinder has a partial dividing wall or undercut or opening edge at which slides are supported axially by a shoulder or hook.

8. The snap fastening according to claim 1;

wherein the fitting is a swivel lever latch or a folding lever latch for fastening in an elongated opening or in two shorter rectangular openings, wherein one opening receives a lever bearing and the other opening receives a lever stop, wherein at least one of the openings also serves to receive at least one body part with holding element according to claim 1.

9. The snap fastening according to claim 8;

wherein the swivel lever latch or folding lever latch has a keyhole plate that is suitable for receiving the actuating lever in a lockable manner, wherein the dish forms the head part of one or two body parts with holding elements in the area of the lever bearing.

10. The snap fastening according to claim 8;

wherein the swivel lever latch or folding lever latch has a dish for receiving the actuating lever in a lockable manner, wherein the dish forms the surface behind which the cam of a lever stop engages on the one hand and forms the head part of a body part with holding elements in the area of the lever stop on the other hand.

11. The snap fastening according to claim 8;

wherein the holding elements are formed by slides which are held so as to be displaceable and whose movement axis lies perpendicular to the longitudinal extension of the dish.

12. The snap fastening according to claim 1;

wherein the fitting is a hinge plate.

13. The snap fastening according to claim 1;

wherein the head part has an offset, wherein the offset can receive bulge of the wall edge.

14. The snap fastening according to claim 1;

wherein two or more holding elements are arranged successively.

15. The snap fastening according to claim 1;

wherein the body part and head part are injection molded so as to form one piece.

16. The snap fastening according to claim 1;

wherein the body part and head part are two parts which are screwed, welded, or snapped together.

17. The snap fastening according to claim 1;

wherein supporting elements are provided for supporting the holding elements after the fitting is mounted in the thin wall, these supporting elements being held or carried by the body part.

18. The snap fastening according to claim 1;

wherein two holding elements which are arranged diametrically opposite from one another are supported by spring arrangements.

19. The snap fastening according to claim 2;

wherein the slides are configured to be shiftable in the cylinder to have self-blocking functionality and provide a self-locking effect°.

* * * * *